US010362922B2

(12) United States Patent
Achenbach

(10) Patent No.: US 10,362,922 B2
(45) Date of Patent: Jul. 30, 2019

(54) ADSORPTION OF PARTICLES ON A MATERIAL CONTAINING A SILICONE POLYMER

(71) Applicant: Wacker Chemie AG, Munich (DE)

(72) Inventor: Frank Achenbach, Simbach (DE)

(73) Assignee: Wacker Chemie AG, Munich (DE)

( * ) Notice: Subject to any disclaimer, the term of this patent is extended or adjusted under 35 U.S.C. 154(b) by 131 days.

(21) Appl. No.: 15/558,428

(22) PCT Filed: Mar. 3, 2016

(86) PCT No.: PCT/EP2016/054492
§ 371 (c)(1),
(2) Date: Sep. 14, 2017

(87) PCT Pub. No.: WO2016/146392
PCT Pub. Date: Sep. 22, 2016

(65) Prior Publication Data

US 2018/0055328 A1 Mar. 1, 2018

(30) Foreign Application Priority Data

Mar. 16, 2015 (DE) ..... 10 2015 204 708

(51) Int. Cl.
*A47L 13/40* (2006.01)
*B08B 6/00* (2006.01)

(52) U.S. Cl.
CPC ..... *A47L 13/40* (2013.01); *B08B 6/00* (2013.01)

(58) Field of Classification Search
CPC ..... A47L 13/40; B08B 6/00
See application file for complete search history.

(56) References Cited

U.S. PATENT DOCUMENTS

| | | | | |
|---|---|---|---|---|
| 4,490,870 | A | 1/1985 | Taub | |
| 2009/0105428 | A1* | 4/2009 | Mihan | C07C 309/63 526/64 |
| 2012/0097035 | A1 | 4/2012 | Chapman | |

FOREIGN PATENT DOCUMENTS

| | | | |
|---|---|---|---|
| DE | 202005018972 | U1 | 1/2007 |
| EP | 1757369 | A2 | 2/2007 |
| WO | 0245564 | A2 | 6/2002 |
| WO | 05011457 | A2 | 2/2005 |
| WO | 12025900 | A1 | 3/2012 |

OTHER PUBLICATIONS

PatBase abstract for DE 20 2005 018972 U1.
K. J. Ryan et al.: Journal of Vinyl & Additive Technology, Mar. 2000, vol. 6, No. 1, p. 7-19.
English Translation of Winnacker/Küchler: Chemische Technik [Chemical Technology], R. Dittmeyer, W. Keim, G. Kreysa, A. Oberholz (Eds.), vol. 5: "Organische Zwischenverbindungen, Polymere" [Organic Intermediates, Polymers], Chapter: "Silicones", Wiley-VCH, Weinheim, 2005.

* cited by examiner

*Primary Examiner* — Sharidan Carrillo
(74) *Attorney, Agent, or Firm* — Brooks Kushman P.C.

(57) ABSTRACT

A device for the dry cleansing of surfaces to remove particulates contains triboelectrically chargeable component (s) of an organic polymer material containing uniformly distributed finely divided silicone polymer particles.

5 Claims, No Drawings

ADSORPTION OF PARTICLES ON A MATERIAL CONTAINING A SILICONE POLYMER

CROSS REFERENCE TO RELATED APPLICATIONS

This application is the U.S. National Phase of PCT Appln. No. PCT/EP2016/054492 filed Mar. 3, 2016, which claims priority to German Application No. 10 2015 204 708.3 filed Mar. 16, 2015, the disclosures of which are incorporated in their entirety by reference herein.

BACKGROUND OF THE INVENTION

1. Field of the Invention

The invention relates to a method for the adsorption of particles by triboelectric charging on a material M containing silicone polymer and a cleaning device containing material M.

2. Description of the Related Art

From esthetic, hygiene, and health viewpoints, thorough building cleaning is an important and demanding task. The removal of household dust is particularly challenging because of its constant formation and extensive distribution. Household dust consists of a multitude of organic and inorganic particles, fibers and substance which have their origin in animals (domestic animals, mites), plants (pollen, seeds), people (flakes of shedded skin, hair), sand, molds, bacteria, viruses, household chemicals (softeners) etc. and thus can cause harm to health (e.g. allergies).

A multitude of cleaning agents, devices and utensils are available for the collection and removal of loose dirt particles in the domestic sector. Basically, a distinction can be made between dry and wet-dry cleaning methods. For the dry cleaning of large, freely accessible surfaces, for example vacuum cleaners can be used. For the dry cleaning of smaller, in particular curvilinear, poorly accessible hard surfaces (furniture, standard lamps, pictures, televisions, radiators, ornamental objects, etc.) the use of various dusters, feather dusters, brooms, hand brushes, wipers, brushes, mops, Swiffer® products, etc., whose mode of operation essentially is based on loose adsorption of the dirt particles on the fabric or the fibers or bristles of the cleaning device, has proved effective. For the dry cleaning of soft surfaces, in particular textiles, brushes and lint rollers can, for example, be used.

It is common to cleaning devices based on dry physisorption of the dirt particles that their effectiveness is predominantly determined by two factors. First, by the size of the surface of the cleaning device collecting the dirt particles, and second, by the strength of the adsorption forces acting between dirt particles and the surface itself. The effective surface of the cleaning device can for example be considerably increased by use of special fabric structures, very thin fibers and bristles (e.g. with slit ends or split), which is for example exploited in microfiber cloths, feather dusters, dust wipers etc. Increasing the adsorption forces of the cleaning device is of particular importance. If the adsorption forces are too small, the dirt particles can only inadequately be bound by the cleaning device, which has the result that these are only distributed from one place to the other, but not removed. An increase in the adsorption forces can be achieved by stronger adhesiveness of the surface (as for example described in WO 2005/011457 A2). In order to avoid direct contact of the adhesive surface e.g. of a lint roller with the substrate to be cleaned, the dirt particles taken up and adsorbed from a first non-adhesive roller can be transferred to a second adhesive roller, as for example described in WO 2012/025900 and DE 20 2005 018 972 U1. However, this method has the disadvantage that simple cleaning of the cleaning device by simple shaking out, knocking out or wiping is now no longer possible and the surface (e.g. of a roller) saturated with dirt particles must be disposed of. Further, a sticky surface can also contaminate or damage the object to be cleaned. Finally, this method fails with fabric-type, fiber or bristle-based cleaning devices since the fibers adhere together and the high coefficient of sliding friction of the cleaning device makes sliding on the object to be cleaned impossible.

A further possibility for increasing the adsorptivity consists in impregnation or coating of the fibers of the cleaning device, for which oils, plant waxes, olive leaf extracts etc. are used. These parts must, as a rule, be thrown away after use.

A further important possibility for increasing the adsorption forces consists in binding the dirt particles electrostatically to a surface of the cleaning device. The electrostatic interaction between dirt particles and cleaning device is a universal process, which is always induced by friction or contact with different materials. This effect, also describe as triboelectric charging, occurs to a different degree of intensity depending on material combination, intensity of friction or contact, atmospheric humidity, temperature etc. While for example lamb's wool or ostrich feathers scarcely become electrostatically charged through friction, a polyurethane foam achieves strong positive charging, and a Teflon® surface achieves strong negative electrostatic charging. More precise consideration shows that different materials in general also possess different electrochemical potentials, which has the result that during the friction process or even simple contact of two materials, electrons are transferred from the material with the higher electrochemical potential to the material with the lower electrochemical potential, as a result of which the former undergoes a positive electrostatic charging, and the latter a negative electrostatic charging. Since the cleaning devices based on dry cleaning considered here come into intensive (frictional) contact with the object to be cleaned, it can be assumed that triboelectric effects contribute not inconsiderably to the adsorption strength of the cleaning device, particularly since the cleaning devices are mostly of plastic materials, i.e. electrical insulators. The surface of the cleaning device electrostatically charged as result of friction or contact is able not only to attract oppositely charged dirt particles, but also dirt particles which are polar or polarized by induction, which themselves have no net charge.

Many cleaning devices are known which deliberately exploit electrostatic charging in order to increase their effectiveness. For example, EP 1 757 369 A2 describes a cleaning device with a dust-binding roller, which on rotation becomes electrostatically charged by means of a friction pad. U.S. Pat. No. 4,490,870 A describes a two-roller cleaning device, whose cleaning roller consisting of a core of natural rubber which is coated with a mechanically electrostatically chargeable silicone elastomer, which possesses a soft, slightly sticky surface. The dirt particles bound on the silicone elastomer as a result of the adhesiveness and electrostatic charge can be transferred and fixed onto a second roller with a surface of pressure-sensitive adhesive. Here the difficulty of creating a firm bond between natural rubber and silicone elastomer proved to be disadvantageous. Further, the creation of a surface layer of silicone elastomer with good electrostatic charging properties is not practically feasible with cleaning textiles and other fiber-based cleaning materials.

The problem was therefore to develop a simple method which makes it possible to increase the effectiveness of cleaning devices based on dry physisorption, without adversely altering their specific functionality (suitability for us). This problem is solved by the method according to the invention.

SUMMARY OF THE INVENTION

The subject of the invention is a method for adsorption of particles by triboelectric charging, in which the particles are adsorbed on a material M which contains organic polymeric material with silicone polymer finely divided therein.

DETAILED DESCRIPTION OF THE PREFERRED EMBODIMENTS

If two different materials are rubbed together or separated after pressing together, an electrostatic charging takes place, whereby one of the materials becomes negatively, and the other positively charged. Different materials have a different electron affinity, because of which the material with the higher electron affinity undergoes a negative charging, and that with lower electron affinity a positive. Further, on rubbing two materials together, it is found that the strength of the charging, i.e. the quantity of charge transferred, is different depending on the material combination. In accordance with the strength and the sign (positive or negative) of the charging in a frictional process, the materials can be arranged in the so-called triboelectric series. The materials with the strongest tendency to positive charging form the positive end of the series, and those with the strongest tendency to negative charging form the negative end. Consequently, materials which show a very low to absolutely no tendency to triboelectric charging are situated in the middle part of this series. The strength of the tendency for positive or negative charging of a material can be measured by the quantity of positive or negative charge (in coulombs) transferred onto the material per Joule frictional energy under defined conditions and thus be quantified (in coulombs/joule). The greater the difference in the tendencies of two materials to charging (i.e. the further apart from one another these are in the triboelectric series), the more strongly will the triboelectric charging take place during the rubbing process.

Silicone polymers are among the material with the highest tendency for negative charging. They are thus located at the negative end of the triboelectric series. If therefore a silicone polymer is rubbed with another material, the silicone polymer always becomes negatively charged and the other material positively, and this becomes more pronounced, the further away the other material is located from the silicone polymer in the triboelectric series. However, in the use of the silicone polymers for the adsorption of particles in cleaning devices, the comparatively high price of the silicone elastomer compositions is an obstacle. Secondly, the production of textile fabrics and fibers from silicone polymer would be extremely laborious and thus expensive. Finally, the mechanical properties and frictional properties of silicone polymers are unsuitable for the functionality of cleaning devices.

Surprisingly, it was found that the tendency of organic polymeric substances to triboelectric charging can be raised almost to the level of a pure silicone polymer by very small contents of silicone polymers, without impairing the other use properties of the organic polymeric substance. Therefore a material M was produced. In particular, because of their silicone-like triboelectric properties the cleaning devices according to the invention containing material M exhibit outstanding dirt uptake and binding. The production of the cleaning devices based on material M can take place according to conventional methods.

The method for the adsorption of particles can be used in the removal or separation of particles in industrial processes such as filtration or screening. Likewise, the method for the adsorption of particles can be used in cleaning for the dry cleaning of surfaces.

Preferably a cleaning device is used in the method which is usually used for dry cleaning, for example vacuum cleaners, vacuum cleaner bags, brooms, brushes, wipers, cloths, sponges, feather dusters, mops, extraction hood filters, pollen filters and fly screens in all embodiments. The part of the cleaning device important for the adsorption is that part of the device which directly takes up, binds, transfers or collects the dirt. These are typically bristles, (micro) fibers, fabrics, fleeces, felts, etc. These can however also be soft rollers, sponges/foams, slubs, combs etc.

The parts of the cleaning device adsorbing the dirt preferably consist of the material M.

The organic polymeric substance can be an organic plastic, such as for example polyolefins (polypropylene, HD and LD polyethylene), polyesters (polybutylene terephthalate and polyethylene terephthalate), polyamides (polyamide 6 and polyamide 6.6), polyimide, polyamide imide, polyphenylene sulfide, aramide, polyacrylonitrile, polyacrylonitrile polymethacrylate copolymer, polyacrylonitrile polyvinyl chloride copolymer, polyvinyl chloride, polytetrafluoroethylene and polyurethane. The organic polymeric substance can also be a polymer of natural origin, such as cellulose (viscose), natural rubber (rubber), polylactide and chitosan. In the context of the increased consideration of sustainability aspects, plant fibers such as cotton, bamboo, hemp, jute, flax, sisal, arenga etc., and of animal origin, such as sheep's wool, goat, cattle and horse hair, silk, ostrich feathers etc., are also used.

In addition, inorganic materials, preferably fillers and fibers, such as glass fibers, carbon fibers, ceramic fibers or metals, in particular metal filaments or wires, can preferably be used in the material M to improve the mechanical properties. All these materials M, optionally in combination as implemented in mixed fabrics, can be further processed into dirt-removing parts of cleaning devices.

Impregnation or coating (not according to the invention) of a material with silicone polymer has the disadvantage that relatively mobile silicones with good spreading properties must be used, which are present only physisorbed on the surface of the cleaning material, and therefore on contact with the surface to be cleaned are transferred onto this. The areas thereby contaminated with silicone show an intensified electrostatic charging which because of the air circulation (convection) constantly present leads to intensified dirt attraction and dirt binding, and thus to increased soiling. Coating with a crosslinkable silicone compound is also found not to be expedient, since silicone elastomer-like surfaces have poor frictional properties (high coefficient of sliding friction).

The material M contains finely divided silicone polymer, which is most preferably present homogeneously, or preferably at least well dispersed in the material M.

Here a homogeneous distribution of the silicone polymer in the material M is preferably understood to mean an average particle size of the silicone polymer particles of less than 0.010 μm, wherein the average particle size D is calculated according to the equation $D=\Sigma n_i D_i/\Sigma n_i$ and the particle diameters $D_i$ of 500 silicone polymer particles are determined by transmission electron microscopy (TEM) of a microtome section (ultrathin section) of the material M; $n_i$ gives the number of the silicone polymer particles with the diameter $D_i$, and $\Sigma n_i=500$ applies. The particle size distribution is determined by evaluation of a series of TEM images, which is performed manually on the graphic tablet. For silicone polymer particles which in the TEM image do not show a circular, but rather an approximately elliptical shape, the diameter $D_i$ of the i-th particle is calculated according to the equation $D_i=(Di_S+Di_N)/2$, wherein $D_{iH}$ represents the length of the major axis and $D_{iN}$ the length of the minor axis of the ellipse. The TEM determination of the average particle size can be performed with the transmission electron microscope from Carl Zeiss AG, LIBRA 120, in the TEM mode (bright field) with an acceleration voltage of 120 kV.

Good dispersion quality of the silicone polymer in the material M is preferably understood to mean an average particle size of the silicone polymer of at most 10 μm, preferably less than 2 μm and most preferably less than 0.500 μm, each determined according to the aforesaid method.

As silicone polymers, in principle, all organosilicon compounds known to those skilled in the art under the term "silicone polymer" are possible. A suitable definition of silicone polymers is found in Winnacker/Küchler: "Chemische Technik" [Chemical Technology], R. Dittmeyer, W. Keim, G. Kreysa, A. Oberholz (Eds.), Vol. 5: "Organische Zwischenverbindungen, Polymere" [Organic Intermediates, Polymers], Chapter: "Silicones", Wiley-VCH, Weinheim, 2005.

Suitable silicone polymers can be substituted or unsubstituted linear oligo- or polydiorganosiloxanes, branched silicone polymers, silicone resins or crosslinked silicone polymers. Of course, mixtures consisting of various silicone polymers can also be used. As already stated, silicone-containing copolymers can also be used, for example polyether-functional silicones, silicones containing urea or urethane units or silicone block copolymers with organic polymers. Especially preferred is the use of high molecular weight polydiorganosiloxanes, which for the purpose of better additivity can also contain non-silicone components, e.g. fillers such as fine-particle silicic acids, chalks, talc and sheet silicates.

Preferably the silicone polymer corresponds to the general formula (1)

$$[R_3SiO_{1/2}]_a[SiR_2O_{2/2}]_b[RSiO_{3/2}]_c[SiO_{4/2}]_d, \quad (1),$$

wherein

R is hydrogen, —OH or an unsubstituted or substituted $C_1$-$C_{18}$ hydrocarbon group and a, b, c, d each mean 0 or an integer and a+b+c+d is an integer from 5-10000.

Examples of $C_1$-$C_{18}$ hydrocarbon groups R are alkyl residues such as the methyl, ethyl, n-propyl, iso-propyl, n-butyl, 2-butyl, iso-butyl, n-pentyl, iso-pentyl, neo-pentyl, and tert-pentyl groups etc., hexyl groups such as the n-hexyl residue, heptyl groups such as the n-heptyl residue, octyl groups such as the n-octyl group and iso-octyl groups such as the 2,2,4-trimethylpentyl group, nonyl groups such as the n-nonyl group, decyl groups such as the n-decyl group, cycloalkyl groups such as cyclopentyl, cyclohexyl, 4-ethylcyclohexyl and cycloheptyl groups, norbornyl groups, and methylcyclohexyl groups. Preferred among the alkyl groups are the $C_1$-$C_6$ alkyl groups such as the methyl and the ethyl groups, in particular the methyl group.

Examples of R are also unsaturated $C_1$-$C_{18}$ hydrocarbon groups, for example alkenyl groups such as the vinyl, 2-propen-2-yl, allyl, 3-buten-1-yl, 5-hexen-1-yl, 10-undecen-1-yl and cycloalkenyl groups (2-cyclohexenyl, 3-cyclohexenyl, cyclopentadienyl group, 2-(cyclohex-3-en-1-yl) ethyl; aryl groups such as the phenyl, biphenylyl and naphthyl group; alkaryl groups such as o-, m- and p-tolyl groups and phenethyl groups (2-phenylethyl, 1-phenylethyl group) and aralkyl groups such as the benzyl group. Preferred unsaturated $C_1$-$C_{18}$ hydrocarbon groups R are vinyl and phenyl groups.

Examples of substituted hydrocarbon groups as groups R are halogenated hydrocarbons, such as the chloromethyl, 3-chloro-propyl, 3-bromopropyl, 3,3,3-trifluoropropyl and 5,5,5,4,4,3,3-heptafluoropentyl groups and the chlorophenyl, dichlorophenyl and trifluorotolyl groups.

The groups R are preferably linked with the silicone polymer (1) via an Si—C bond, but can also be bound to the silicone polymer via an oxygen atom —O—.

R preferably has 1 to 6 carbon atoms. Especially preferred are ethyl, phenyl, vinyl and methyl groups.

Preferably a+b+c+d is at least 10, nire preferably at least 100, and in particular at least 1000 and at most 15,000, more preferably at most 10,000, and in particular at most 7000.

Preferably c+d is such that $<0.1\times(a+b+c+d)$, in particular $c+d<0.05\times(a+b+c+d)$.

Preferably at least 50%, more preferably at least 70%, and in particular, at least 80% of all groups R are methyl group.

In principle, all silicone polymers corresponding to the formula (1) can be used; however, silicone polymers with a dynamic viscosity of greater than 1000 mPa·s, preferably measured according to DIN EN ISO 3219: 1994 and DIN 53019 with a "MCR 302" rheometer from Anton Paar, wherein a plate-cone system (cone CP50-2) with an aperture angle of 2°, diameter 50 mm is used, and the measurement temperature is 25.00° C.+/−0.05° C. and the shear rate 1 $sec^{-1}$, are preferable.

Because of the incompatibility/immiscibility of silicone polymers and most organic polymers, it is preferable to avoid sweating/bleeding of the silicone polymer from the material of the cleaning device; otherwise, the aforesaid disadvantageous silicone contamination of the surface to cleaned might occur.

The bleeding can be prevented by using a silicone polymer with a very high molecular weight, e.g. a UHMW polysiloxane (ultra-high molecular weight; described in K. J. Ryan et al. Journal of Vinyl & Additive Technology, March 2000, Vol. 6, No. 1, p. 7-19).

The degree of polymerization of UHMW polysiloxanes lies in the range from >1000 up to ca. 14,000, which corresponds to number average molecular weights between 74 kg/mol and 1000 kg/mol. Typical UHMW polysiloxanes have a dynamic viscosity between 10 kPa·s and 50 kPa·s, preferably between 15 kPa·s and 30 kPa·s, preferably measured on an air-suspended rotational rheometer according to DIN EN ISO 3219: 1994 and DIN 53019, wherein a plate-plate system (diameter 25 mm) with a measurement gap of 0.5 mm is used. The measurement temperature is 25.00° C.+/−0.1° C. The shear rate gradient is 0.1 $sec^{-1}$. The viscosity represents the arithmetic mean value of three independently performed individual measurements.

Because of the large chain length of a UHMW polysiloxane, a physical entanglement with the polymer chains of the cleaning material takes place, which prevents bleeding. Surprisingly, it is nonetheless established that the triboelectric properties of a material with very small contents of silicone added in this manner almost correspond to those of a pure silicone polymer, and on the other hand the other properties (in particular its sliding friction resistance) are practically unchanged. The bleeding of the silicone polymer is also prevented if the material M contains silicone block copolymers, in particular in which the non-silicone block is compatible with the material M. For example, in the case of a polyester fiber as material M, addition of a polysiloxane polyester block copolymer could be performed.

A third possibility or preventing bleeding of the silicone polymer consists in covalent bonding of the silicone polymer to the polymer chains of the material M. For example, a silicone polymer functionalized with vinyl groups or (meth)acryl groups can be radical bonded to organic polymers. Further reactions usable for the covalent bonding are hydrosilylation, condensation, thiol-ene reaction, azide-alkyne reaction, anionic or cationic polymerization, Michael addition etc. The fixing of the silicone in the cleaning material can also be effected by use of a crosslinkable silicone rubber compound, which disperses e.g. in a thermoplastic material and under shearing in the heat is crosslinked to give a thermoplastic silicone vulcanization product.

Especially preferable according to the invention, due to its low cost and effectiveness, is the use of high molecular weight polydimethylsiloxanes, whose dynamic viscosity lies between 1 kPa·s and 50 kPa·s, preferably between 10 and 40 kPa·s, most preferably between 15 and 30 kPa·s (preferably measured by the method described above).

The silicone polymers are commercially available as ready to use pellets/granulates or masterbatches and can, for example, be mixed into a thermoplastic plastic granulate before further processing thereof.

It is clear to those skilled in the art that suitable silicone addition process must be selected depending on the cleaning material and its processing and production conditions.

The desired triboelectric effect is obtained according to the invention through very low contents of silicone polymer in the material M. As is shown in the examples, contents of silicone polymer in the sub-percent range can be sufficient. Depending on the tendency of the cleaning material to electrostatic charging, higher contents in the single figure percentage range can become necessary. Preferably, only as much silicone is added as is necessary for the reliable obtention of the effect. As is shown in the examples, a further increase in the silicone content above a certain content does not lead to a further increase in the tendency of the cleaning material to charging. However, the content of silicone polymer in the material M should be at least 0.0001 wt. %, preferably at least 0.01 wt. %, most preferably at least 0.1 wt. % and in every case less than 10 wt. %, preferably less than 5 wt. % and most preferably less than 2 wt. %.

EXAMPLES

Conditioning and Measurement of the Electrostatic Charging

The triboelectric charging is characterized on the basis of the electric field strength (measured in kV/inch). For this, in each case plastic plates 2 mm thick with the dimensions 80 mm×120 mm were produced and positioned vertically to that their surface made a gap from a field strength measuring instrument of 1 inch, as recommended by the manufacturer of the measuring instrument. The measuring instrument is the Electrostatic Fieldmeter NILSTAT MODEL 775 from ION SYSTEMS, Inc. The measuring instrument was earthed according to the manufacturer's recommendation and adjusted to a starting field strength of zero +/−0.02 kV/inch. The measurements of the electric field strength were performed at a room temperature of 23° C. and an atmospheric relative humidity of 48%.

The plastic plates were cleaned with isopropanol before the experiment was performed, and the measurements were made on the following day. The conditioning (discharging) of the plastic plates was effected by carefully neutralizing these with an ionization blower, which generates positive and negative ions and passes them outwards in an air flow. The device Sartorius Stat-Fan YIB01 from SARTORIUS AG was used. This is capable of neutralizing objects in a working area of 600×600 mm. The plastic plates were neutralized at a blower distance of 10 cm within 1 min at medium blower revolution rate.

The triboelectric charging of the plastic plates was effected by means of a twin roller device specially designed for this purpose, which makes it possible to determine the intrinsic triboelectric charging tendency of a material largely independently of its coefficient of sliding friction (which can differ considerably from material to material), which is achieved by intensive contacting and subsequent separation. The twin roller device consists of two silicone foam rollers (diameter 20 mm, length 15 cm) coverable with the friction material (e.g. microfiber cloth), and touching one another in measurement mode, in which the plastic plates are drawn five times successively through the roller gap and the measurement then immediately made. The pressure force of the upper roller pressing on the lower roller was adjusted by means of weights so that in the measurement mode the upper roller presses onto the lower roller with a total weight of 600 g, corresponding to a weight force of 5.886 N. The lower roller driven by a motor rotates with a speed of 50 revolutions/min., whereby in measurement mode the plastic plate introduced into the roller gap is drawn in and through. Through the constant pressure of the two rollers, a comparable and intimate contacting of plastic plate and friction material was achieved, which in the end manifested itself in the good reproducibility of the field strengths measured. The twin roller device earthed on the metal stand was also neutralized with the aforesaid ionization blower shortly before the measurement. A total of 5 measurements were performed for each plastic-friction material combination and the median value of the field strength determined. The results are shown in table 3.

Preparation of the Plastic Plates

For the production of the compounds and plastic plates, three base materials were used. Compound 1: polypropylene PP Maplin® EP200M, density 0.9 g/cm$^3$, MFR@230° C./2.16 kg=8 g/10 min., Manufacturer Basell Polyolefine GMbH, Frankfurt. Compounds 3-5: High-Density Polyethylene HDPE Lupolen® 5031 L, density 0.952 g/cm$^3$, MFR@190° C./2.16 kg=6.5 g/10 min., Manufacturer Basell Polyolefine GmbH, Frankfurt. Compound 6: polybutylene terephthalate PBT Ultradur® B 4500, density 1.3 g/cm$^3$, MFR@250° C./2.16 kg=19 g/10 min., Manufacturer BASF SE, Ludwigshafen.

Six compounds (composition and production conditions according to table 1) were produced on a KraussMaffei Berstorff (Hanover, Germany) ZE 25 double-screw extruder.

For this, all components were mixed to give a dry blend and the dry blend was metered gravimetrically into the intake region of the extruder. The resulting extrudate was cooled in a water bath and granulated.

TABLE 1

| Compound | 1 | 2 | 3 | 4 | 5 | 6 |
|---|---|---|---|---|---|---|
| Polymer | PP | PP/talc Compound[1]) | HDPE | HDPE | HDPE | PBT |
| Parts by weight polymer % | 99 | 97 | 99 | 97 | 95 | 99 |
| Parts by weight GENIOPLAST ® Pellet S % | 1 | 3 | 1 | 3 | 5 | 1 |
| Content of UHMW polysiloxane[2]) (wt. %) | 0.7 | 2.1 | 0.7 | 2.1 | 3.5 | 0.7 |
| Conditions for the compounding | | | | | | |
| L/D | 47 | 47 | 47 | 47 | 47 | 47 |
| Temperature ° C. | 190 | 190 | 195 | 195 | 195 | 270 |
| Screw revolution rate rpm | 300 | 400 | 300 | 300 | 300 | 350 |
| Throughput kg/h | 10 | 10 | 10 | 10 | 10 | 15 |

[1])PP/Talc Compound:

67.2% polypropylene medium impact copolymer with melt index 33 g/10 min (230° C./2.16 kg) according to DIN ISO 1133 from SABIC Europe, Sittard, NL.
10.0% polyolefin elastomer with density 0.87 g/cm$^3$, melt index 5 g/10 min (190° C./2.16 kg) according to DIN ISO 1133 from Dow Chemical Company, Midland, MI, USA.
20.0% Talc JetFine ® 3CA from Imerys, Paris, France.

2.0% Carbon Black Masterbatch PLASBLAK ® LL2590 from Cabot Corporation, Boston, MA, USA.
0.2% Ca stearate 0.6% antioxidant, UV stabilizer

[2])UHMW polysiloxane: "Ultra-High Molecular Weight" polydimethylsiloxane

Production of Injection Molded Plates (Plastic Plates)

Injection molded plates with a smooth surface and dimensions of 8 cm×12 cm and a thickness of 2 mm were produced on an Engel ES 600/125 injection molding machine under the conditions stated in table 2 from the compounds 1-6 thus produced and the reference polymers (PP, HDPE, PBT) without silicone additive.

TABLE 2

| | Injection molding conditions | | | |
|---|---|---|---|---|
| Plate made from | Temperature ° C. | Injection rate mm/s | Back pressure bar | Holding pressure bar |
| PP | 250 | 120 | 180 | 25 |
| Compound 1 | 250 | 120 | 180 | 25 |
| PP/Talc Compound | 250 | 40 | 30 | 25 |
| Compound 2 | 250 | 40 | 30 | 25 |
| HDPE | 255 | 120 | 310 | 35 |
| Compound 3 | 255 | 120 | 310 | 35 |
| Compound 4 | 255 | 120 | 310 | 35 |
| Compound 5 | 255 | 120 | 310 | 35 |
| PBT | 260 | 120 | 220 | 34 |
| Compound 6 | 260 | 120 | 220 | 34 |

In addition to the plastic plates, a 2 mm thick sheet of liquid silicone rubber was produced. For this, the A and B components of the liquid silicone rubber ELASTOSIL® LR 3003/50 (Wacker Chemie AG) in the mass ratio 1:1 were intimately mixed on a roller mill for 15 mins. at a roller temperature of 25° C. This mixture was then crosslinked in a hydraulic press for 15 mins. at a temperature of 170° C. The demolded 2 mm thick silicone elastomer sheet was subjected to a tempering lasting 4 hours at 200° C. in an air circulation drying cabinet.

Materials Used for Rubbing the Plastic Plates a) Microfiber cloth "Microfasertuch PREMIUM Professional" from MOPPTEX GmbH (Austria); Article No. 300565 blue.
b) Silicone-free cotton cloth: standard cotton fabric, unsoiled, Order Code: 10000, Name: 10A, 100% cotton, width 100 cm, ca. 170 g/m$^2$, wfk Testgewebe GmbH, Brueggen (Germany).
c) Paper: Filter paper from Schleicher & Schuell, Dassel (Germany), circular filter, Ø 150 mm, Ref. No. 311812.

TABLE 3

| | | Friction material | | |
|---|---|---|---|---|
| Plate made from | Silicone content (wt. %) | Microfiber cloth | Silicone-free cotton cloth Field strength (kV/inch) | Paper |
| pp *) | 0 | −3.1 | −4.2 | −4.0 |
| PP Compound 1 | 0.7 | −13.8 | −12.1 | −17.3 |
| PP/Talc *) | 0 | −4.0 | −6.6 | −13.9 |
| PP/Talc Compound | 2.1 | −8.3 | −10.7 | −17.1 |
| HDPE *) | 0 | −2.8 | −8.9 | −8.1 |
| HDPE Compound 3 | 0.7 | −12.7 | −13.5 | −13.9 |
| HDPE Compound 4 | 2.1 | −11.9 | −14.1 | −12.8 |
| HDPE Compound 5 | 3.5 | −10.4 | −13.2 | −12.0 |
| PBT *) | 0 | −8.3 | −7.4 | −2.9 |
| PBT Compound 6 | 0.7 | −14.2 | −12.6 | −13.7 |
| ELASTOSIL ® LR 3003/50 *) | 100 | −12.6 | −13.5 | −13.9 |

*) not according to the invention

As is clear from table 3, a silicone content of less than 1 wt. % already causes a drastic increase in the field strength, which corresponds to a stronger electrostatic charging of the plastic as a result of friction. The HDPE examples confirm that no further increase in the charging takes place through considerably higher silicone contents; evidently, the maximal triboelectric charging achievable with silicones is already reached at very low silicone contents. This is also confirmed by the electrostatic charging of a liquid silicone elastomer (LR 3003/50), the magnitude whereof does not exceed that of the silicone-containing plastics.

The invention claimed is:

1. A method for adsorption of particles by triboelectric charging, comprising adsorbing the particles on a material M which comprises an organic polymer material with silicone polymer(s) finely distributed therein, wherein the content of the silicone polymer in the material M is at least 0.0001 wt. % and less than 10 wt. % and wherein said silicon polymer comprises UHMW polysiloxane (ultra-high molecular weight silicone) having a dynamic viscosity from 1 kPa·s to 50 kPa·s at 25° C.

2. The method of claim 1, wherein the organic polymer material is an organic plastic.

3. The method of claim 1, wherein the organic polymer material is selected from the group consisting of polyolefin, polyester, polyamide, polyimide, polyamide imide, polyphenylene sulfide, aramide, polyacrylonitrile, polyacrylonitrile polymethacrylate copolymer, polyacrylonitrile polyvinyl chloride copolymer, polyvinyl chloride, polytetrafluoroethylene and polyurethane.

4. The method of claim 1, wherein the UHMW polysiloxane is a linear polydiorganosiloxane.

5. The method of claim 1, wherein the UHMW polysiloxane has an average particle size of less than 10 μm.

* * * * *